US007367456B2

(12) United States Patent
Oder et al.

(10) Patent No.: US 7,367,456 B2
(45) Date of Patent: May 6, 2008

(54) AIR JIG FOR SEPARATION OF MINERALS FROM COAL

(75) Inventors: Robin R. Oder, Export, PA (US); Richard S. Weinstein, Bismarck, ND (US)

(73) Assignee: EXPORTech Company, Inc., Pittsburgh, PA (US)

( * ) Notice: Subject to any disclaimer, the term of this patent is extended or adjusted under 35 U.S.C. 154(b) by 257 days.

(21) Appl. No.: 10/778,435

(22) Filed: Feb. 13, 2004

(65) Prior Publication Data

US 2004/0217040 A1 Nov. 4, 2004

Related U.S. Application Data

(60) Provisional application No. 60/447,828, filed on Feb. 14, 2003.

(51) Int. Cl.
*B03C 1/30* (2006.01)

(52) U.S. Cl. ..... 209/39; 209/218; 209/142; 209/478; 209/219

(58) Field of Classification Search ..... 209/39, 209/142, 143, 218, 139.1, 215, 219, 81, 12.1, 209/478, 40

See application file for complete search history.

(56) References Cited

U.S. PATENT DOCUMENTS

| | | | | |
|---|---|---|---|---|
| 2,512,422 | A * | 6/1950 | Fletcher et al. | 209/475 |
| 3,472,379 | A * | 10/1969 | Gaetz et al. | 209/479 |
| 3,852,168 | A * | 12/1974 | Oetiker | 209/469 |
| 5,277,368 | A * | 1/1994 | Kindig | 241/20 |
| 6,467,631 | B2 * | 10/2002 | Strangalies et al. | 209/474 |
| 6,540,088 | B2 * | 4/2003 | Oder et al. | 209/218 |
| 6,814,240 | B2 * | 11/2004 | Loth | 209/40 |

OTHER PUBLICATIONS

Brandner, Edward D. et al. "A New Fly Ash Separator Combining Magnetic Forces with Air Drag" Oct. 2003.*

* cited by examiner

*Primary Examiner*—Kaitlin S. Joerger
(74) *Attorney, Agent, or Firm*—Ansel M. Schwartz

(57) ABSTRACT

An improved air jig apparatus and method is disclosed in which a dry magnetic separator is used to separate paramagnetic and ferromagnetic minerals from the dust component of coal cleaned with the air jig. The cleaned product of the dry magnetic separator is combined with the cleaned product of the air jig thereby improving both the quality and the quantity of the unmodified air jig product. The dry magnetic separator may be of a variety of types including but not limited to separators made from permanent magnets, electromagnets, and superconducting magnets, each of which may also employ triboelectric and/or aerodynamic means to enhance the separation of the dust material.

24 Claims, 7 Drawing Sheets

Block Flow Diagram of an Improved Air Flow Separator.

Figure 1. Block Flow Diagram of an Improved Air Flow Separator.

Figure 2. Schematic View of an Air Flow Separator.

Figure 3. Perspective View of a Belt Magnetic Separator.

Figure 4. Vertical Section Through a Belt Magnetic Separator Showing the Splitter Configuration.

Figure 5. Lines of Magnetic Flux in the Permanent Magnetic Separator.

Figure 6. Result of Calculation of the Magnetic Energy Gradient 0.1 mm above the Surface of the Permanent Magnet Illustrated in Figure 5.

AIR JIG FOR SEPARATION OF MINERALS FROM COAL

The above identified prior filed provisional application, namely application 60/447,828, filed Feb. 14, 2003, whose benefit is being claimed was filed in the English language.

FIELD OF THE INVENTION

The present invention pertains to improved method and apparatus for separation of mineral contaminants from coal which uses a dry magnetic separator to treat the dust component produced when an air jig cleans coal containing small particles.

BACKGROUND OF THE INVENTION

Dry methods for separation of mineral contaminants from coal were used in the 1800's and peaked around 1965 when wet methods which are more effective in mineral separation were developed. With the growth of concern for the massive volumes of wet refuse to be managed, however, interest is again growing in the development of dry methods for ore dressing. Additionally, in arid regions of the world where water is not available for wet processing, dry methods have always been of interest.

Air jigs are now being considered again for dry cleaning of raw coal. (J. K. Alderman and R. J. Snoby, "Improving Power Plant Performance and Reducing Emissions through the use of Pneumatic Dry Cleaning of Low Rank Coal," Preprint 01-120, 2001 SME Meeting, Feb. 26-28, Denver, Colo., incorporated by reference herein). However, air jigs are ineffective in cleaning coal particles larger than 50 mm and smaller than 0.6 mm diameter (R. P. Killmeyer, Jr. and A. W. Deurbrouck, "Performance Characteristics of Coal-Washing Equipment: Air Tables," Report of Investigations PMTC679, April, 1979, incorporated by reference herein). It is not unusual for a significant portion of the raw coal to have sizes smaller than ¼ inch. Further, air jigs are generally limited to "black-and-white" separations at 1.6 specific gravity or higher. Separations at specific gravities much below 1.6 are simply not feasible. Pneumatic cleaning of coal particles which have a wide range of particle sizes can be complex and expensive. One approach is to screen the coal into coarse and fine sizes and to treat each separately. This is undesired because of the poor performance at fine sizes and because it increases costs. Alternatively, small particles can be lost to the process by discarding the fine particles screened out before jigging or by discarding the fine coal blown through the jig which is collected in a bag house or other method used to keep dust to a minimum. Either of these approaches represents a severe loss in heating value. Alternatively, the fine particles can be collected with the coarse product but this will raise the ash and sulfur levels in the cleaned coal. Indeed, the concentrations of mineral contaminants, especially pyritic sulfur, tends to be higher in the fine fraction than in the coarser components of most coals. All together, the ineffectiveness of the air cleaning devices in treating fine coal has limited the application of this technology.

Air jigs have specific advantages associated with the use of pulsating air rather than water. They have specific disadvantages also in that separation of coal particles larger than 45-50 mm is virtually impossible. Further, processing of unsized feeds such as 50 mm topsize results in excessive misplaced material. Additionally, the air jig like many other dry processes, has a practical upper surface moisture limit of about 6%. Lastly, dust control is a necessity.

SUMMARY OF THE INVENTION

The present invention combines a modern air jig and a dry magnetic separator to achieve improved recovery and greater ash and sulfur reductions when cleaning nominal 50 mm topsize coal.

It is unusually fortuitous and was unanticipated that this combination of technologies can extend the practicality of each. The dust which must be collected in operation of the air jig can be further processed most efficiently by the dry magnetic method thus making a significant improvement in the coal recovery when using the air jig. Additionally, it is fortuitous in that the high air velocities employed by the air jig also remove surface moisture from the coal thus improving the efficiency of the dry magnetic separator. The combination is significantly more efficient than either alone.

Modern magnetic separators can be used to process the fine fraction of coals to separate paramagnetic minerals. This can have a significant effect on improving the recovery and lowering the ash and sulfur of the product of the air jig. Improved versions of magnetic separators can greatly enhance the acceptance of the air jig in modern processing of coal and other minerals. Dry magnetic separators, however, have not found acceptance in the coal mining industry because of problems of treating large quantities of coal. For example, a belt magnetic separator has a limit to coal topsize because of the short range of the gradient magnetic fields required in making the separations. This topsize for coal is generally in the ¼ inch range. The all dry separators are limited by surface moisture much as the air jig is. Additionally, it may be impractical to grind the entire product of the mine to nominally ¼ inch topsize so that it could be processed by a dry magnetic separator. It can also be very expensive to scale this type separator to throughputs characteristic of a coal mine. In processing coal, 15 to 25 tons per hour is a practical upper limit of throughput with a single ceramic magnet belt separator.

An improved air jig separation apparatus is revealed herein where the problem of lost recovery and inefficient performance in cleaning particles of a broad range of sizes is solved by diverting the stream of particles screened from the feed to the air jig or collected in the dedusting operation to a dry magnetic separator from which mineral gangue is rejected and the clean coal is then combined with the clean coal fraction of the coarse coal prepared by the air jig. This combination of technologies helps the air jig and provides a practical application in which a dry magnetic separator can be used.

The present invention pertains to an apparatus for separation of minerals of a material mixture. The apparatus comprises a pneumatic dry cleaner which receives the mixture and produces a first stream from dry pneumatic stratification which is carried by gas out of the cleaner. The apparatus comprises a dry magnetic separator for processing the first stream from the cleaner.

The present invention pertains to a method for separation of minerals of a material mixture. The method comprises the steps of receiving the mixture by a pneumatic dry cleaner. There is the step of producing a first stream from the mixture with the cleaner with dry pneumatic stratification which is carried by gas out of the cleaner. There is the step of processing the first stream from the cleaner with a dry magnetic separator.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
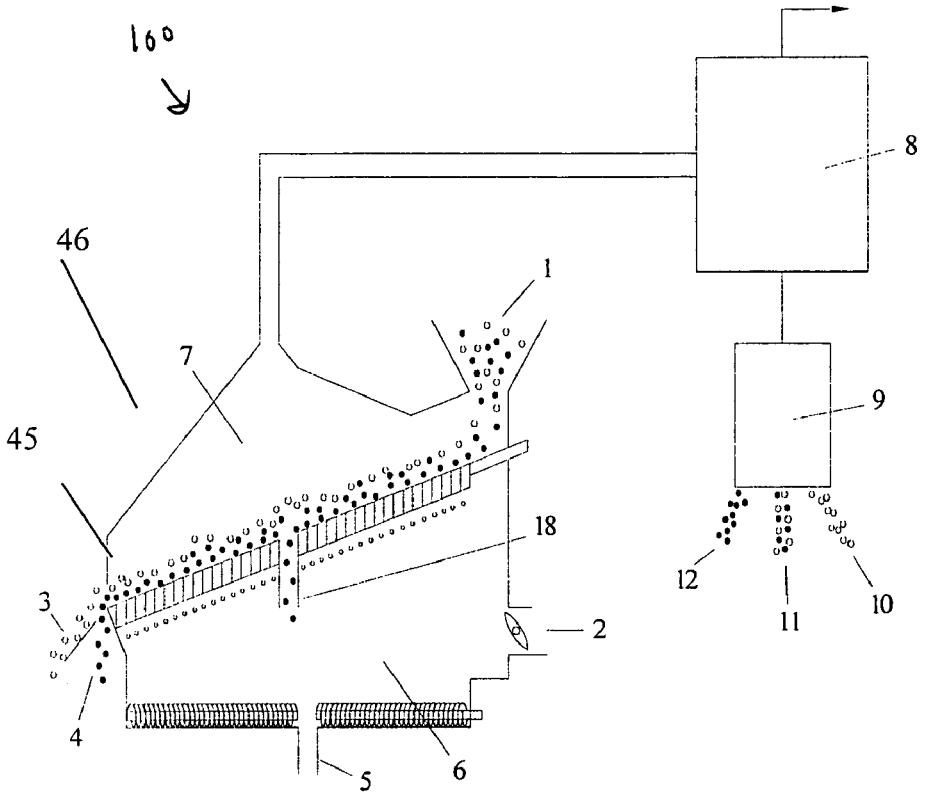
FIG. 1 is a block flow diagram of an improved air flow separator.

Referring now to the drawings wherein like reference numerals refer to similar or identical parts throughout the several views, and more specifically to FIG. 1 thereof, there is shown an apparatus 100 for separation of minerals of a material mixture. The apparatus 100 comprises a pneumatic dry cleaner which receives the mixture and produces a first stream from dry pneumatic stratification which is carried by gas out of the cleaner. The apparatus 100 comprises a dry magnetic separator 9 for processing the first stream from the cleaner.

Preferably, the apparatus 100 includes a dust collector 8 which receives the first stream from the cleaner and provides an underflow from the first stream which is fed to the separator. The dust collector 8 is connected with the cleaner and positioned adjacent the separator to provide the underflow to the separator. The cleaner preferably removes surface moisture from the first stream.

Preferably, the cleaner is an air jig 46. The air jig 46 preferably includes a feed bin 1 through which the mixture is fed to the air jig 46. Preferably, the air jig 46 produces clean coal, middlings, refuse, hutch material and fines. The air jig 46 preferably includes a dust hood 7 through which the fines are discharged from the air jig 46 and passed to the dust collector 8. Preferably, the dust collector 8 separates solids from air and sends the solids to the magnetic separator 9.

The magnetic separator 9 preferably receives solids and produces clean coal, middlings and refuse.

Preferably, the clean coal from the air jig 46 and the magnetic separator 9 are combined. The hutch material, the air jig 46 refuse and the magnetic separator 9 refuse preferably are discarded. Preferably, the middlings from the air jig 46 and the magnetic separator 9 can be reprocessed by the air jig 46 or discarded. The middlings from the magnetic separator 9 preferably can be reprocessed by the magnetic separator 9. Preferably, the magnetic separator 9 has a first stage and has a second stage. The first stage preferably is a belt separator and the second stage is another belt separator or a dry open gradient magnetic separator 9. Preferably, the air jig 46 separates clean coal from the mixture through stratification produced by pulsating air flow. The air jig 46 preferably reduces surface moisture of the fines being processed by the magnetic separator 9. Preferably, the air jig 46 reduces the surface moisture below 6% in the fines.

The present invention pertains to a method for separation of minerals of a material mixture. The mixture comprises the steps of receiving the mixture by a pneumatic dry cleaner. There is the step of producing a first stream from the mixture with the cleaner with dry pneumatic stratification which is carried by gas out of the cleaner. There is the step of processing the first stream from the cleaner with a dry magnetic separator 9.

Preferably, there are the steps of receiving the first stream with a dust collector 8 from the cleaner; and providing an underflow from the first stream by the dust collector 8 to the separator. The dust collector 8 is connected with the cleaner and positioned adjacent the separator to provide the underflow to the separator. There is preferably the step of removing surface moisture from the first stream with the cleaner. Preferably, there are the steps of receiving by the magnetic separator 9 the underflow having solids, and producing clean coal, middlings and refuse with the magnetic separator 9 from the solids. There is preferably the step of combining clean coal from the cleaner and the separator.

In the operation of the invention, the improved air flow separator of this invention is illustrated in the block flow diagram of FIG. 1. An air jig 46, a dust collector 8, and a dry magnetic separator 9 are combined to achieve efficient cleaning of coal which has a broad range of particle sizes. Raw coal is fed to the air jig 46 through a feed bin 1. Pulsating air is fed from underneath the separator at 2. The separator makes five products. Clean coal 3 is discharged at the lower end of the separator 45, middlings 4 may be discharged at the lower end of the separator, refuse may be discharged through a refuse draw 18 or at the lower end of the separator, high sulfur and ash material called hutch 5 is discharged through the plenum chamber 6 and fines are discharged overhead through the dust hood 7. The fine material is recovered by a dust collection system 8. Depending on the coal and the desired product, the dust collection system may be composed of a cyclone, or a bag house, or a combination of these or other suitable methods for separating fine coal from air. The solids discharge from the dust collection system 8 is then sent to a dry magnetic separator 9 suitable for processing nominally ¼ inch topsize particles where a separation of clean coal 10, middlings 11, and refuse 12 is made. The clean coal 3 from the airflow jig and the dry magnetic separator 9 are combined. The hutch material 5, the air jig 46 refuse, and the refuse from the magnetic separator 9 are discarded and the middlings 11 can be combined with product, reprocessed, or discarded.

Figure 2:
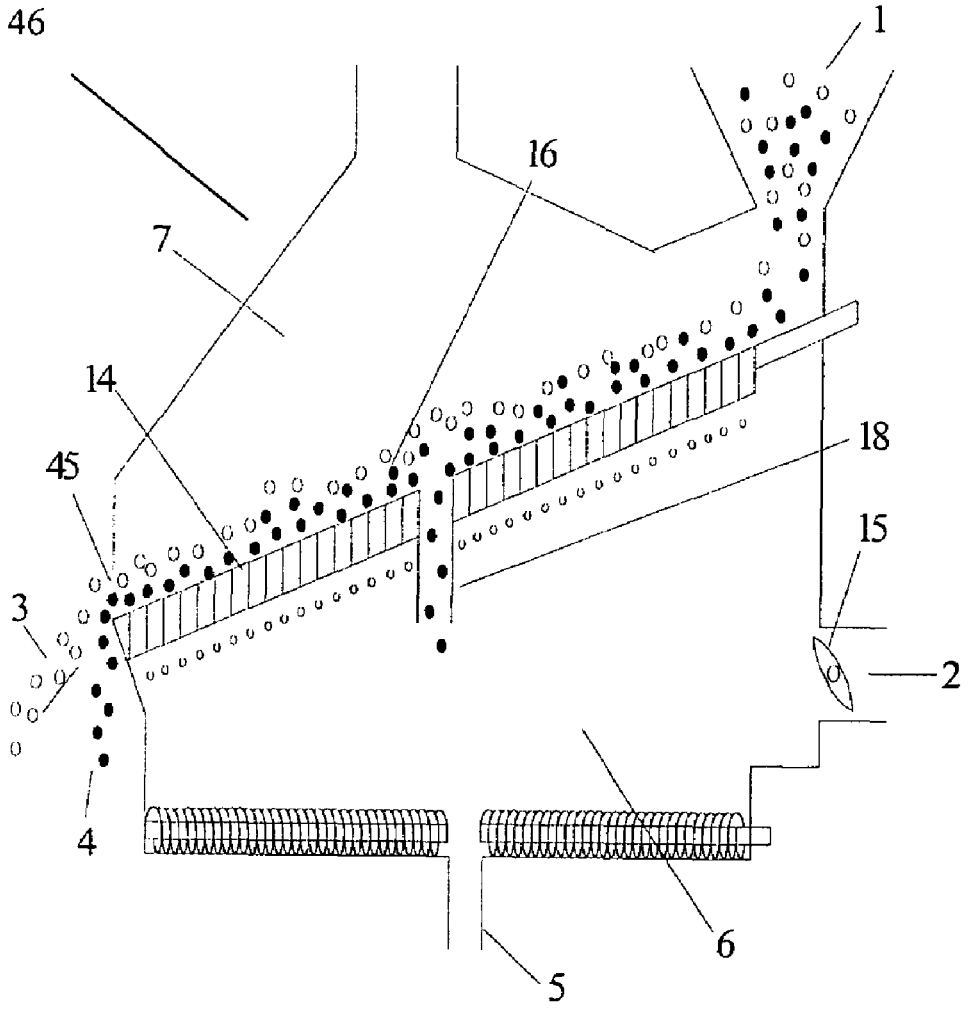
FIG. 2 is a schematic view of an air flow separator.

The air jig 46 separates clean coal from its associated impurities by means of stratification produced by pulsating air flow. FIG. 2 is a cut-away drawing of an airflow cleaner typical of those used in the mid 1960's. The raw feed 1 enters the machine at the upper end of an oscillating, porous deck 14 mounted over an air space called a plenum chamber 6. Air is pulsated through the plenum chamber by means of a rotating butterfly damper 15. The deck is fastened into place with partition plates (not shown) which divide the deck into compartments spaced every few inches. These compartments are filled with ceramic balls (not shown) and thus serve the purpose of equalizing the air distribution over the entire deck surface.

Repeated stratification causes differential settling with the heavier refuse 16 settling to the bottom of the coal bed where it is removed either at the lower end of the table 45 or through draws 18 spaced along the deck length which extend across the deck width. One draw is shown in FIG. 2. The upper layer of coal continues to travel over the bed of refuse and is discharged at the bottom end of the machine 45 as the cleaned product. If refuse draws 18 are employed, then a middling fraction 4 can be withdrawn at the bottom of the machine. Hutch material 5, a fine, high sulfur and ash product that sifts through the deck, is discharged with the refuse. Any particles which are entrained by air go through an overhead dust hood 7 to the dust collection system 8. This material is decoupled from the air and sent to the dry magnetic separator 9.

The deck oscillates at typically 600 strokes per minute with ¼ inch amplitude, and air is supplied at a rate varying from 200 to 900 cubic feet per minute per square foot of deck surface. The higher air flow rates are used for stratifying the coarser coals up to two inch top size.

The dry magnetic separator 9 may be of any type suitable for processing the dust stream from the air jig 46. These types may include belt magnetic separators of the type described in U.S. Pat. No. 6,041,942 ("Magnetic Catalyst Separation Using Stacked Magnets," Terry L. Goolsby, Mar. 28, 2000, incorporated by reference herein) and used to recover moderately magnetic fine dry catalyst particles; electromagnets as described in Perry's Chemical Engineers' Handbook, Seventh Edition, Late Editor Robert H. Perry, Editor Don W. Green, Associate Editor James O. Maloney, McGraw Hill, 1997; a ParaTrap™ magnetic separator as described in U.S. Pat. No. 5,017,283 ("Method of Magnetic Separation and Apparatus Therefore," R. R. Oder, May 21, 1991); a separator combining a belt magnetic separator and a ParaTrap™ magnetic separator processing the clean or a middling fraction from the belt separator as described in U.S. application Ser. No. 09/514,048; a separator combining triboelectric and magnetic forces as described in U.S. application Ser. No. 09/908,115; a separator combining aerodynamic and magnetic forces as described in U.S. application 60/406,768; or combinations thereof (all of which are incorporated by reference herein). Generally, the dry magnetic separators may be of permanent magnet, electromagnet, or superconducting magnet design.

For coals with small sulfur contents or with unoxidized iron pyrite impurities, such as some sub-bituminous and lignitic coals, belt type separators or versions thereof employing magnetic, aerodynamic, and electric forces may be employed. For coals, such as bituminous containing relatively large amounts of mineral sulfur, iron pyrite, a combination of belt separator and ParaTrap™ separator can be effective. The belt separator operates as a scalper which removes magnetic minerals which could plug the flow path of the ParaTrap™. These are mineral impurities which exhibit magnetic susceptibilities generally greater than $1\times10^{-6}$ to $5\times10^{-6}$ emu/g-oe. The ParaTrap™ separator is effective in separation of feebly magnetic particles with susceptibilities generally smaller than $5\times10^{-6}$ emu/g-oe in the particle size range smaller than nominally 8 mesh.

Figure 3:
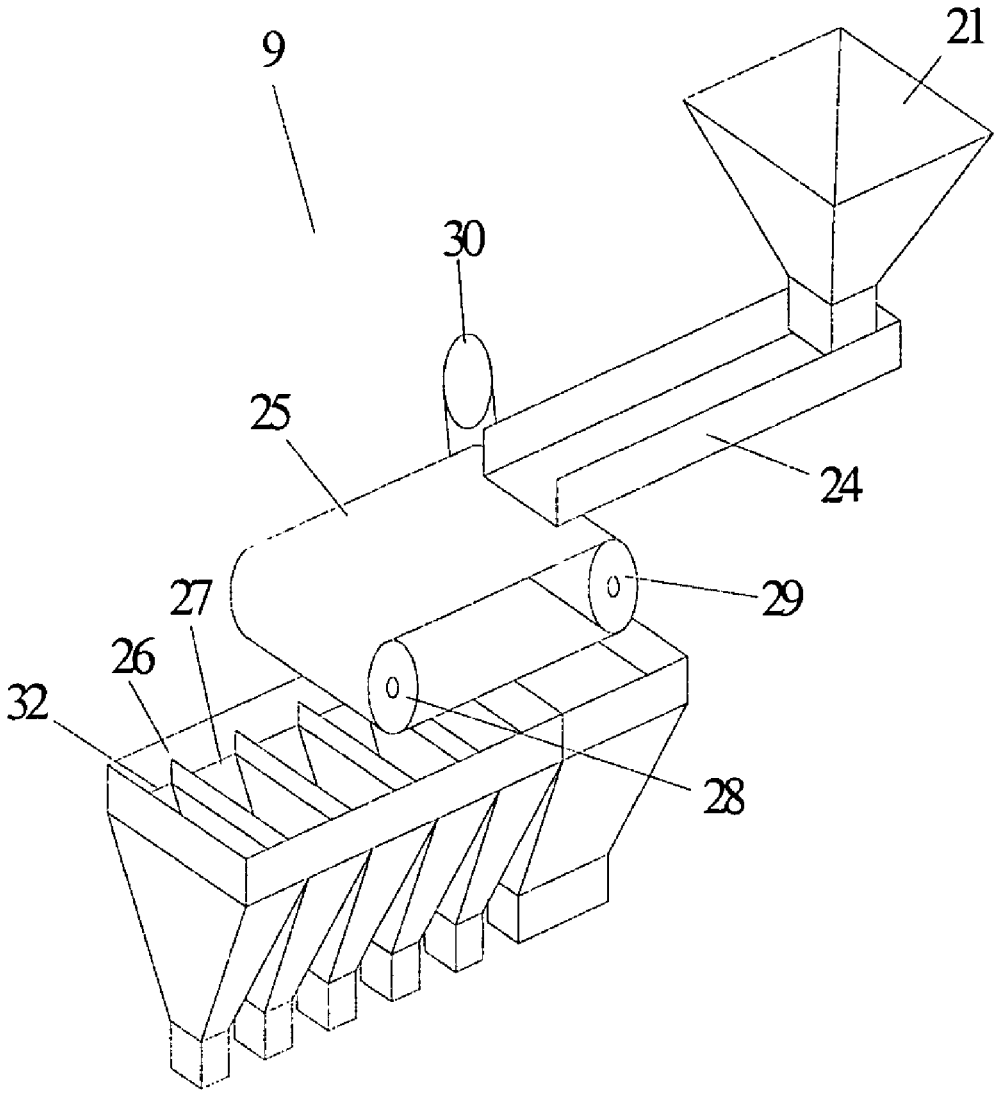
FIG. 3 is a perspective view of a belt magnetic separator.

FIG. 3 is a schematic description of a preferred embodiment employing a belt type magnetic separator 9 processing the minus ¼ inch dust fraction from an air jig 46. Other embodiments can employ the separators mentioned above as will become apparent to those skilled in the art.

A perspective view of the belt magnetic separator 9 is shown in FIG. 3. The unit has flow dividers 26 and receiving bins 27 located at the magnet end 28 and underneath the belt 25. Coal is transferred from the dust collector 8 of the air jig 46 into the hopper 21. The coal mixture containing particles of differing magnetic characteristics is fed from the bottom of the hopper 21 onto the surface of the vibratory tray 24. The vibratory feeder 24 prepares a flowing stream of particles of uniform thickness and controls the rate at which particles are fed onto the surface of the moving belt 25 at the idler pulley 29 end of the belt 25. The belt speed is controlled by a drive motor 30 which changes the rate of rotation of the magnet pulley.

The material being carried by the belt 25 will be separated into particles of differing levels of magnetism at the magnet end of the belt. The least magnetic particles will be collected in the receiver 32 located at the greatest distance from the leading edge of the magnetic roller 28 and upon separating from the magnet will follow a trajectory dictated by their momentum and aerodynamic drag. Particles of strong magnetism will be carried around the perimeter of the magnet and deposited in the receivers underneath the belt 25. They will follow a trajectory given by their momentum and the aerodynamic drag. Particles of intermediate magnetism will land in the receivers between the two extremes depending upon magnetism, momentum, and aerodynamic drag.

Figure 4:
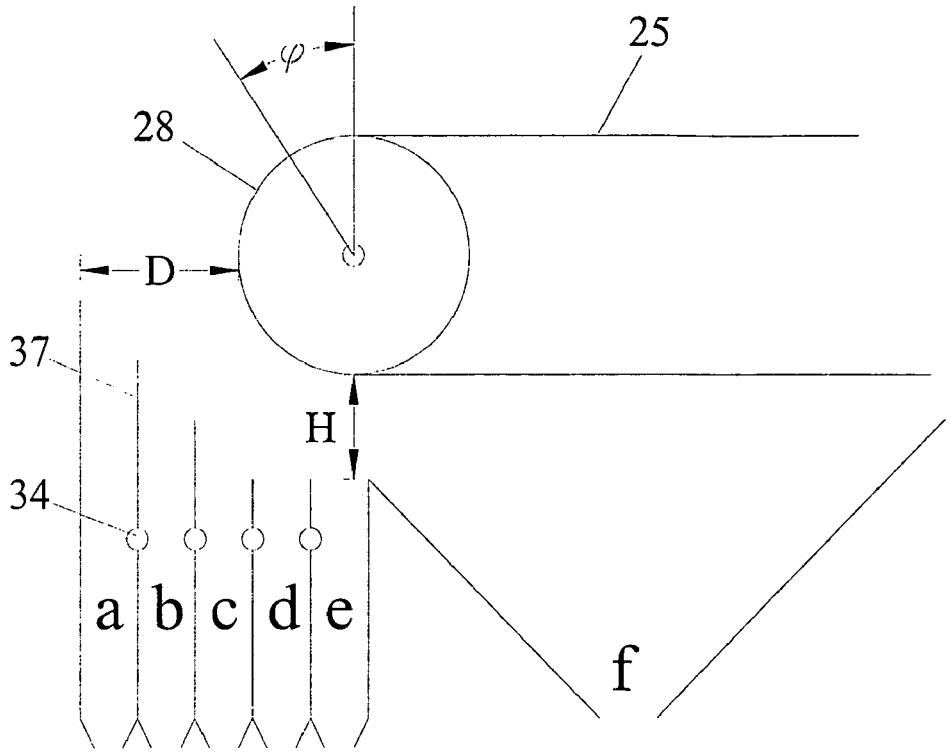
FIG. 4 is a vertical section through a belt magnetic separator showing the splitter configuration.

FIG. 4 is a vertical section midway along the length of the cylindrical magnet showing the hinged mechanism 34 for adjusting the openings of the receivers. The distance, D, from the leading edge of the magnet 28 to the outermost edge of the farther most receiver is fixed. Additionally, the elevation of belt above the receivers, H, underneath the belt is also fixed. The width of the openings of the receivers can be adjusted by rotating the upper portion of the dividers 37 either clockwise or counterclockwise at the hinges 34.

For the configuration shown in FIGS. 3 and 4, a magnetic particle is attracted to the surface of the magnet 28 as the belt 25 moves over the surface of the magnet. If the particle is sufficiently magnetic to overcome the inertial force tending to throw the particle off the belt 25, then it will travel with the belt 25 and be collected in receivers d, e or f shown in FIG. 4 depending upon the magnitude of the attraction, the least magnetic landing in receiver d and the most magnetic landing in receiver f. Particles for which the resultant force of attraction to the surface of the magnet is not sufficient to overcome the repulsive effect of gravitational and inertial forces will be released from the belt 25 at an angle, $\phi$, with respect to the vertical which is less than 180 degrees depending upon the resultant of all of the forces involved. After leaving the surface of the belt 25 with momentum directed tangential to the surface of the magnet at the point of departure, the particles move under the influence of gravity and aerodynamic drag such that they land in the appropriate receiver, a, b, c, or d.

Referring to FIGS. 3 and 4, the material collected in receiver f generally represents the most magnetic particles. For these particles the magnetic force at the bottom of the separator is greater than the weight of the particles. The particles are drug away from the attraction of the magnet and eventually fall from the belt. Inertial and aerodynamic forces carry them into the receivers underneath the belt. The smallest of the magnetic particles in the feed to the separator tend to be concentrated in receiver f.

Figure 5:
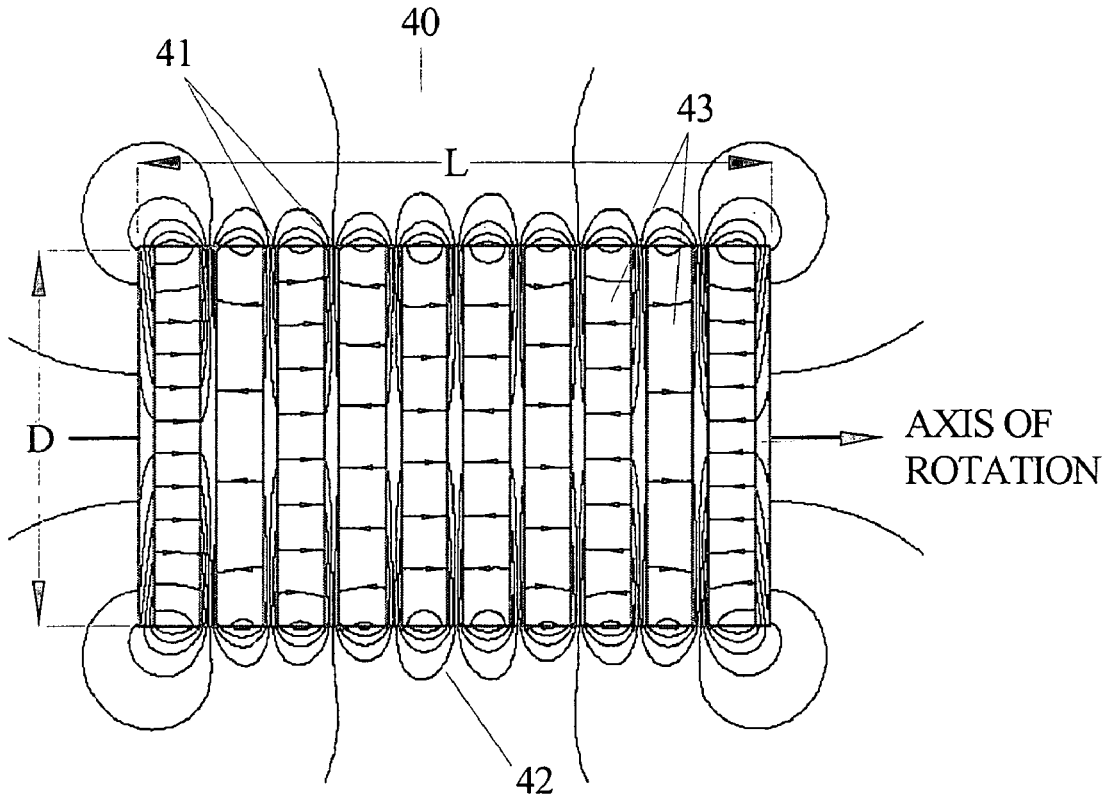
FIG. 5 shows the lines of magnetic flux in the permanent magnet separator.

A vertical section along the length and through the center of the permanent magnet 40 used to produce the magnetic force of attraction is shown in FIG. 5. The magnet consists of a cylindrical arrangement of alternating segments of permanent magnets 43 separated by thin cylindrical carbon steel spacers 41. The permanent magnets are magnetized parallel to the axis of the cylinder and are arranged so that nearest faces are magnetized in opposite directions. In this arrangement, the lines of magnetic flux 42 emerge and return radially over the outside surfaces of the carbon steel spacers 41. These surfaces are the regions of high magnetic force corresponding to high values of the magnetic energy gradient, $M_{eg}$. Any permanent magnet with sufficient demagnetizing force can be employed. Permanent magnets made from mixtures of neodymium, iron, and boron are preferred to produce large forces. The thickness of the permanent magnets 43 and the spacers 41 can be adjusted to produce maximum force on the surface of the magnet.

Figure 6:
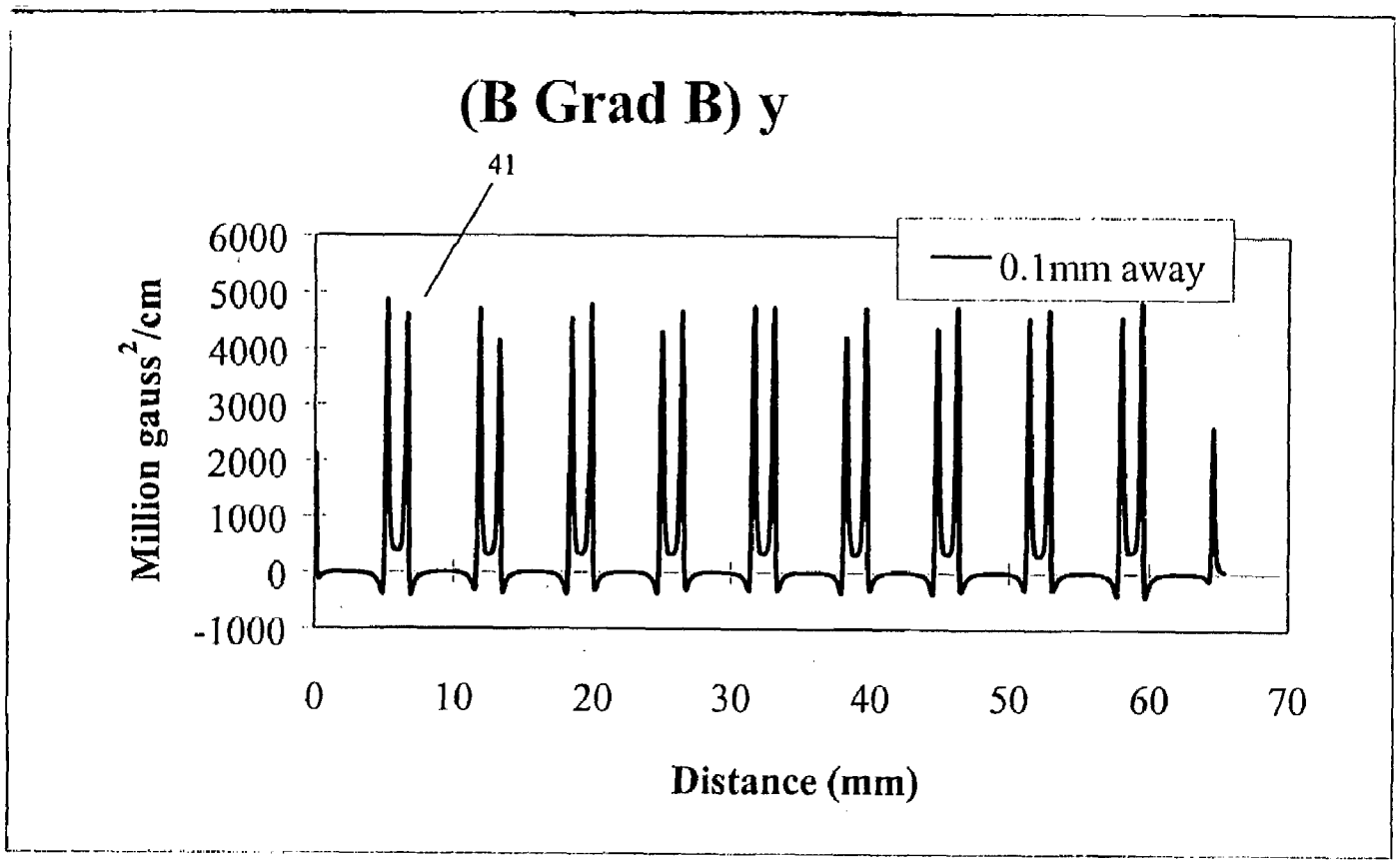
FIG. 6 shows the result of calculation of the magnetic energy gradient 0.1 mm above the surface of the permanent magnet illustrated in FIG. 5.
Figure 7:
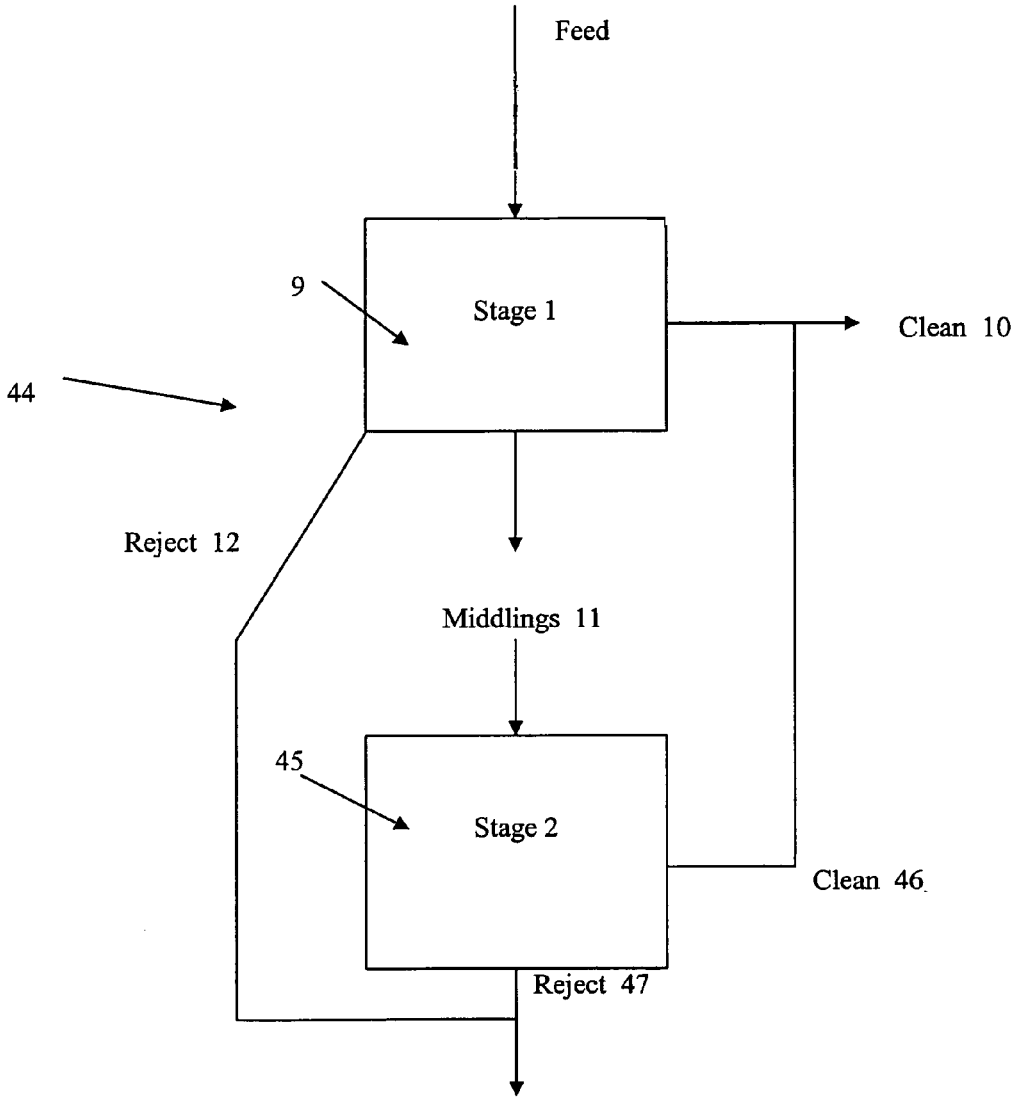
FIG. 7 is a block diagram regarding the two stages of the Magnetic Separator.

Calculated values of the inward directed component of the magnetic energy gradient, $M_{eg}=B\Delta B$ (gauss$^2$/cm), on the surface of a belt which is 0.1 millimeters thick, are plotted versus distance x along the length of a neodymium$_2$-iron$_{14}$-boron$_1$ permanent magnet in FIG. 6. For this example, the magnet is 2 inches in diameter and 2.7 inches long. It has 10 permanent magnet wafers each of which is 0.2 inches thick and 11 wafers of carbon steel each of which is 1/16 inches thick. The structure is held together by a 3/8 inch diameter rod made from non-magnetic material which passes through a hole in the center of each permanent magnet and carbon steel spacer. The peak values of $M_{eg}$ are located at the edges of the carbon steel spacers 41. It can be appreciated that levels of the $M_{eg}$ drop off rapidly as one moves in a vertical direction away from the surface of the magnet.

EXAMPLES

A lignite from North Dakota was processed with an air jig at the rate of 75 tons feed per hour. The lignite particles were 2 inches in topsize. The results of the testing are shown in Table I.

TABLE I

Results of Processing Lignite with an Air Jig

| Sample | Recovery (wt. %) | Moisture (wt. %) | Ash (wt. %) | Dry Energy (Btu/Lb) | Sulfur (wt. %) | $SO_2$/MBtu |
|---|---|---|---|---|---|---|
| Feed | 100 | 30.65 | 28.84 | 8588 | 1.33 | 3.10 |
| Av. Prod. | 69 | 32.40 | 18.83 | 9857 | 1.30 | 2.64 |
| Av. Fine | 22 | 26.27 | 36.74 | 7514 | 1.18 | 3.14 |
| Rejects | 9 | 19.75 | 73.93 | 2445 | 2.12 | 17.36 |

Twenty-two percent of the feed to the air jig was collected in a bag house dust collector. The material, 1/4 inch topsize, had 26.27% moisture, 36.74% ash and 1.18% sulfur, and 7,514 Btu/lb, on a dry basis. This material was processed with a belt separator of the type shown in FIG. 3.

The diameter of the permanent magnet was 4 inches and its length was 2.7 inches. The distance from the front of the permanent magnet to the far edge of canister No. 1 is 2.75 inches. Each canister was 1 inch wide and extended the entire length of the cylindrical magnet. Splitter No. 1 was angled so that the top of the splitter arm was 45 mm from the far edge of canister No. a which is the reference point for all of the splitter settings. The top of the splitter arms for No. 2, No. 3, and No. 4 splitters were 50.8, 71.5, and 101.6 mm from the reference point respectively. A Kevlar belt which was 0.005 inches thick was employed. The roller turned at 100 RPM and the lignite was fed at the rate of 86 pounds per hour. The results of processing the air jig dust fraction are shown in Table II.

TABLE II

Results of Magnetic Separation of Air Jig Dust Component

| Canister No. | Weight Recovery, wt. % | Dry Basis Ash wt. % Dry | Dry Basis Sulfur wt. % Dry | Magnetic Susceptibility Micro cc/g |
|---|---|---|---|---|
| a | 7.58 | 12.23 | 1.31 | 1.58 |
| b | 44.28 | 20.26 | 1.41 | 2.17 |
| c | 26.87 | 41.89 | 1.38 | 2.70 |
| d | 6.05 | 55.34 | 1.22 | 4.69 |
| e | 3.03 | 69.94 | 1.13 | 24.18 |
| f | 12.18 | 73.79 | 1.05 | 68.59 |
| Composite | 99.99 | 35.63 | 1.33 | 11.06 |

The magnetic separator 9 has split the air jig dust into six different fractions with ash and sulfur levels shown in Table II. The magnetic susceptibility of each of the six components was measured with a Johnson Mathey Model MK I magnetic susceptibility balance. The results are shown in the table.

The composite products which can be made by combining the air jig products with the products of the dry magnetic separation are shown in Table III. The data of Table III are given on a dry basis.

TABLE III

Composite Products

| Sample | Recovery (wt. %) | Ash (wt. %) | Sulfur (wt. %) | Heat Content (Btu/Lb) | $LbSO_2$/MBtu | Btu Recovery (%) |
|---|---|---|---|---|---|---|
| Air Jig Product | 69.00 | 18.83 | 1.33 | 9857 | 2.70 | 78.05 |
| | 70.67 | 18.67 | 1.33 | 9903 | 2.69 | 80.31 |
| | 80.41 | 18.87 | 1.34 | 9877 | 2.71 | 91.14 |
| Magnetic Separator Product | 86.32 | 20.44 | 1.34 | 9665 | 2.78 | 95.73 |
| | 87.65 | 20.97 | 1.34 | 9593 | 2.79 | 96.49 |
| | 88.32 | 21.34 | 1.34 | 9543 | 2.81 | 96.72 |
| | 91.00 | 22.89 | 1.33 | 9335 | 2.85 | 97.47 |
| Air Jig Reject | 100.00 | 27.49 | 1.4 | 8715 | 3.22 | 100.00 |

It can be seen from the table that use of the dry magnetic separator 9 to process the air jig fines can recover additional material that would have been lost. By doing this the Btu recovery of the air jig product for this lignite can be increased from 78.05% to 91.14% without substantially hurting the $LbSO_2$/MBtu.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for cleaning a material mixture of raw coal comprising:

a pneumatic dry cleaner which receives the mixture of raw coal and produces a first stream from dry pneumatic stratification which is carried by gas out of the cleaner in a first direction and discharges clean coal in a second direction;

a dry magnetic separator separate and apart from the cleaner for processing the first stream from the cleaner and separating feebly magnetic particles with susceptibilities generally smaller than $5\times10^{-6}$ emu/g-oe in a particle size range smaller than nominally 8 mesh; and a dust collector disposed between the cleaner and the separator which receives the first stream and provides at least a portion of the first stream to the separator, the dust collector connected with the cleaner and positioned adjacent the separator.

2. An apparatus as described in claim 1 wherein the dust collector receives the first stream from the cleaner and provides an underflow from the first stream which is fed to the separator, the dust collector connected with the cleaner and positioned adjacent the separator to provide the underflow to the separator.

3. An apparatus as described in claim 2 wherein the air jig separates clean coal from the mixture through stratification produced by pulsating air flow.

4. An apparatus as described in claim 3 wherein the air jig reduces surface moisture of the fines being processed by the magnetic separator.

5. An apparatus as described in claim 3 wherein the cleaner includes an oscillating porous deck on which the mixture is disposed and through which the pulsating air is equally distributed.

6. A method for cleaning a material mixture of raw coal comprising the steps of:

receiving the mixture of raw coal by a pneumatic dry cleaner;

producing a first stream from the mixture with the cleaner with dry pneumatic stratification which is carried by gas out of the cleaner in a first direction and discharging clean coal in a second direction; and processing the first stream from the cleaner with a dry magnetic separator and separating feebly magnetic particles with susceptibilities generally smaller than $5\times10^{-6}$ emu/g-oe in a particle size range smaller than nominally 8 mesh.

7. A method as described in claim 6 including the steps of receiving the first stream with a dust collector from the cleaner; and providing an underflow from the first stream by the dust collector to the separator which is separate and apart from the cleaner, the dust collector connected with the cleaner and positioned adjacent the separator to provide the underflow to the separator.

8. A method as described in claim 7 including the step of oscillating a porous deck of the cleaner on which the mixture is disposed and through which pulsating air is equally distributed.

9. A method as described in claim 8 including the step of removing surface moisture from the first stream with the cleaner.

10. A method as described in claim 9 including the steps of receiving by the magnetic separator the underflow having solids, and producing clean coal, middlings and refuse with the magnetic separator from the solids.

11. A method as described in claim 10 including the step of combining clean coal from the cleaner and the separator.

12. An apparatus as described in claim 8 wherein the cleaner removes surface moisture from the first stream.

13. An apparatus as described in claim 12 wherein the cleaner is an air jig.

14. An apparatus as described in claim 4 wherein the air jig includes a feed bin through which the mixture is fed to the air jig.

15. An apparatus as described in claim 14 wherein the air jig produces clean coal, middlings, refuse, hutch material and fines.

16. An apparatus as described in claim 15 wherein the air jig includes a dust hood through which the fines are discharged from the air jig and passed to the dust collector.

17. An apparatus as described in claim 16 wherein the dust collector separates solids from air and sends the solids to the magnetic separator.

18. An apparatus as described in claim 17 wherein the magnetic separator receives solids and produces clean coal, middlings and refuse.

19. An apparatus as described in claim 18 wherein the clean coal from the air jig and the magnetic separator are combined.

20. An apparatus as described in claim 19 wherein the hutch material, the air jig refuse and the magnetic separator refuse are discarded.

21. An apparatus as described in claim 20 wherein the middlings from the air jig and the magnetic separator can be reprocessed by the air jig or discarded.

22. An apparatus as described in claim 21 wherein the middlings from the magnetic separator can be reprocessed by the magnetic separator.

23. An apparatus as described in claim 22 wherein the magnetic separator has a first stage and has a second stage.

24. An apparatus as described in claim 23 wherein the first stage is a belt separator and the second stage is another belt separator or a dry open gradient magnetic separator.

* * * * *